US005325037A

United States Patent [19]

Jeong

[11] Patent Number: 5,325,037

[45] Date of Patent: Jun. 28, 1994

[54] MOTOR CONTROL SYSTEM AND METHOD FOR A FUEL BURNER

[75] Inventor: Jae H. Jeong, Suweon, Rep. of Korea

[73] Assignee: Samsung Electronics Co., Ltd., Suwon, Rep. of Korea

[21] Appl. No.: 913,765

[22] Filed: Jun. 30, 1992

Related U.S. Application Data

[63] Continuation of Ser. No. 750,310, Aug. 27, 1991, abandoned.

[30] Foreign Application Priority Data

Aug. 27, 1990 [KR] Rep. of Korea ..... 90-13239

[51] Int. Cl.[5] ..... G05F 5/02

[52] U.S. Cl. ..... 318/805; 318/778; 431/6

[58] Field of Search ..... 318/778, 783, 777, 800, 318/803, 706, 805; 323/300, 319; 431/27, 25, 6, 69, 70, 19

[56] References Cited

U.S. PATENT DOCUMENTS

| | | | |
|---|---|---|---|
| 3,725,655 | 11/1973 | DuVall | 318/634 |
| 4,117,384 | 9/1978 | Armstrong | 318/326 |
| 4,156,169 | 5/1979 | Imamura | 318/616 |
| 4,300,083 | 11/1981 | Heiges | 318/686 |
| 4,459,099 | 7/1984 | Grunden et al. | 431/27 |
| 4,490,794 | 12/1984 | Griffith et al. | 318/584 |
| 4,527,045 | 7/1985 | Nakajima et al. | 323/241 |
| 4,683,411 | 7/1987 | Hamilton, Jr. et al. | 318/706 |
| 4,804,916 | 2/1989 | Frank | 323/300 |
| 4,922,169 | 5/1990 | Freeman | 318/254 |
| 5,085,573 | 2/1992 | Geary | 431/27 |

*Primary Examiner*—William M. Shoop, Jr.
*Assistant Examiner*—John W. Cabeca
*Attorney, Agent, or Firm*—Burns, Doane, Swecker & Mathis

[57] ABSTRACT

A motor control system for a fuel burner comprises a microprocessor and a voltage fluctuation compensating portion provided with a bridge circuit for rectifying the current of a power source, a portion for generating a comparison signal having a delay time corresponding to the voltage fluctuation of the rectified signal from the bridge circuit and a portion for generating a zero-crossing signal from the voltage signal of the bridge circuit, whereby a microprocessor determines whether a power voltage applied to the system is higher or lower than a normal voltage. The microprocessor generates a compensating signal programmed to equalize the fluctuation power to the reference power and a controller controls the power to be applied to a load according to the compensating signal.

5 Claims, 5 Drawing Sheets

MOTOR CONTROL SYSTEM AND METHOD FOR A FUEL BURNER

This application is a continuation of application Ser. No. 07/750,310, filed Aug. 27, 1991, now abandoned.

BACKGROUND OF THE INVENTION

The invention relates to a motor control system for a fuel burner, and particularly to a burner motor control system and method for a fuel burner to reduce the efforts of the fluctuation of the power voltage applied thereto.

A conventional motor control system of a fuel burner, as shown in FIG. 1 and FIG. 2, comprises a power source 1 for generating the power voltage required for a fuel burner system, an inputting portion 2 for receiving signals detected which relate to numerous key inputs including the present and the set temperature desirable to the user, as well as states of a frame rod short circuit, an igniter, a blower motor rotation and a burner motor rotation, etc. Also, included is a system control portion 3 for controlling the operation of loads such as the igniter, the blower motor and the burner motor based on the detected signals, and a microprocessor 4 for determining a heating step dependent upon the comparison of the present temperature with the set temperature from the inputting portion 2, and for operating an electronic pump 5 coming up with the heating step and having its program predetermined for feeding a control signal to the burner motor BM so as to assure air necessary for the combustion of fuel injected into a burner 6. The burner motor BM is provided with a photocoupler including a light emitting diode 7 operated by a burner motor driving control signal from the microprocessor 4 and a transistor 7' saturated by the light received from the light emitting diode to initiate a burner motor driving portion 8.

In a conventional system, while power is being supplied to a microprocessor 4, it controls the system control portion 3 in a first stage according to the temperature signal from the inputting portion 2 desirable to user. After the predetermined time passes, the microprocessor 4 determines the heating stage dependent upon the result of the comparison between the temperature set and the present temperature received from the inputting portion 2. The determined stage is applied to the light emitting device 7, to the control data for the operation of the electronic pump 5 and the operating signal of the burner motor BM for supplying air necessary in the fuel combustion to the burner 6. At that time, the transistor 7' called the light receiving element is alternately operated in an on or an off position in response to the signal of the light emitting diode 7 to trigger the gate of a thyristor SCR, so that the burner motor is grounded through a regulating circuit having a bridge circuit BD, constant regulated voltage resistors $R_2$, $R_3$ and a constant regulated voltage condenser $C_1$ which is applied to an AC power source VC. Herein it is known that the thyristor SCR detects the amplitude of the power voltage to control the rotation speed of the burner motor BM. A resistor $R_4$ and a condenser $C_2$ not explained are respectively arranged to connect the burner motor BM to the ground.

If the power voltage of the burner motor BM is higher or lower than the reference voltage, a voltage fluctuation changes the amplitude of the power voltage which hinders the stability of the motor speed. It induces the uncompleted combustion of the burner 6 due to the non-uniform volume of air required in a fuel combustion.

A typical technique for maintaining the stability of the amplitude of the power voltage to be applied regardless of the voltage fluctuation is described in U.S. Pat. No. 4,117,384 issued to Armstrong. The Armstrong patent reveals a circuit for processing the a.c. output of a tachogenerator 5 whose frequency is proportional to the speed of a rotor of the tachogenerator, in which a voltage level detection means 7 is responding to the a.c. output, a key pulse producing means G1 is responding to at least one output of the detection means 7 to produce a key pulse whose duration is inversely proportional to the rotational speed, a first gating means G2 or G3 is responding to an output of the detection means and an output of the key pulse producing means to produce a reset pulse after a predetermined period in the interval between each key pulse, and a voltage generator 6 is responding to each reset pulse to provide a predetermined output level and is responding to each key pulse to ramp that output level at a predetermined rate for the duration of that key pulse. Whereby the output level of the voltage generator during each of the predetermined periods is a predetermined function of the rotational speed.

The circuit relates to the detection of the voltage fluctuation in a power source N within the duration of the sample pulses generated by incorporating the first key pulse generating means G1 or G2 into the voltage generator 6 as well as the control of an output voltage regarding the rotation number of the motor. Armstrong does not teach the processing of the fluctuation voltage which is a higher or a lower voltage than the reference voltage of a motor to be fed.

Thus, the amplitude changes of a power voltage to be applied to a load such as a burner motor BM, especially the input voltage fluctuations, need to be compensated. However such a compensation technique is not realized in the prior art.

The main object of the invention is to provide a load control system for rapidly detecting the fluctuations of a power voltage to be applied so as to compensate for it.

Another object of the invention is to provide a load control system for simply realizing the detection of the voltage fluctuation regarding the application of a power source.

Still another object of the invention is to provide a burner motor control system which compensates for the voltage fluctuation of a power source to keep the rotational speed of a burner motor uniform.

Still another object of the invention is to provide a burner motor control method which compensates for the voltage fluctuation of a power source to keep the rotational speed of a burner motor at a constant regulated voltage.

SUMMARY OF THE INVENTION

In order to achieve the aforementioned objects, the invention pertains to a load control system, in which an inputting portion receives numerous key input signals and signals from the peripheral equipment of the system, a microprocessor determines the system's heating stage considering the received signals as numerous parameters to apply the control parameter signals generated according to its program to a system control portion, and the system control portion controls the peripheral loads of the system, especially the voltage amplitude of a power source to be applied, to keep the rotation of a load motor at a predetermined rate.

Accordingly, during the fluctuation of the power voltage applied, the invention realizes a voltage fluctuation compensating control portion which generates a comparison signal corresponding to the size of the voltage fluctuation and a zero-crossing signal. The microprocessor judges whether the input power voltage is higher or lower than the normal voltage based on the sensed signals and thereby generates the compensating signal according to the voltage fluctuation.

BRIEF DESCRIPTION OF THE INVENTION

The invention will be explained in detail below with reference to the accompanying drawings, in which.

DETAILED DESCRIPTION OF THE INVENTION

Figure 1:
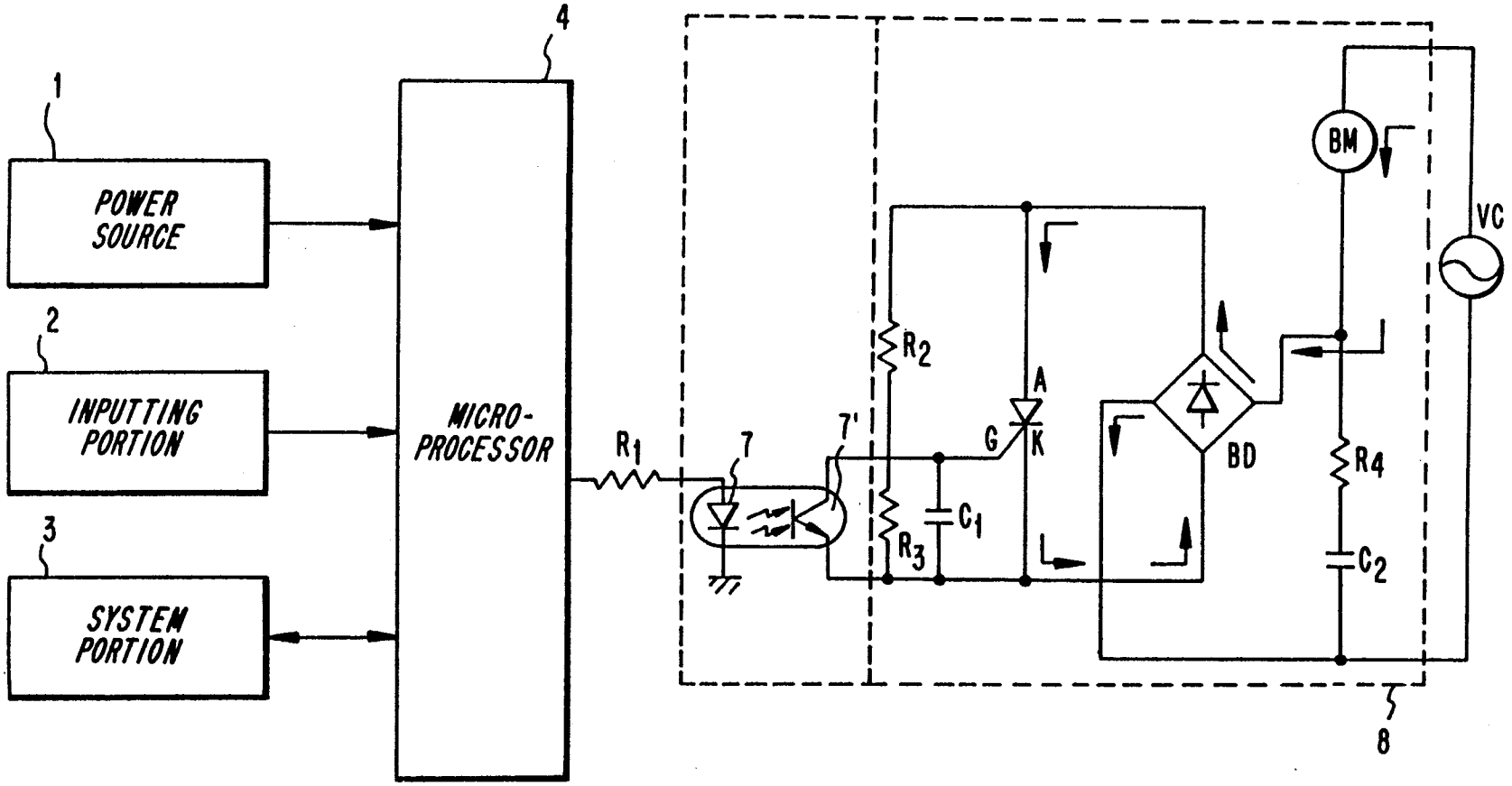
FIG. 1 PRIOR ART
FIG. 1 is the control circuit of a burner motor according to a conventional fuel burner.
Figure 2:
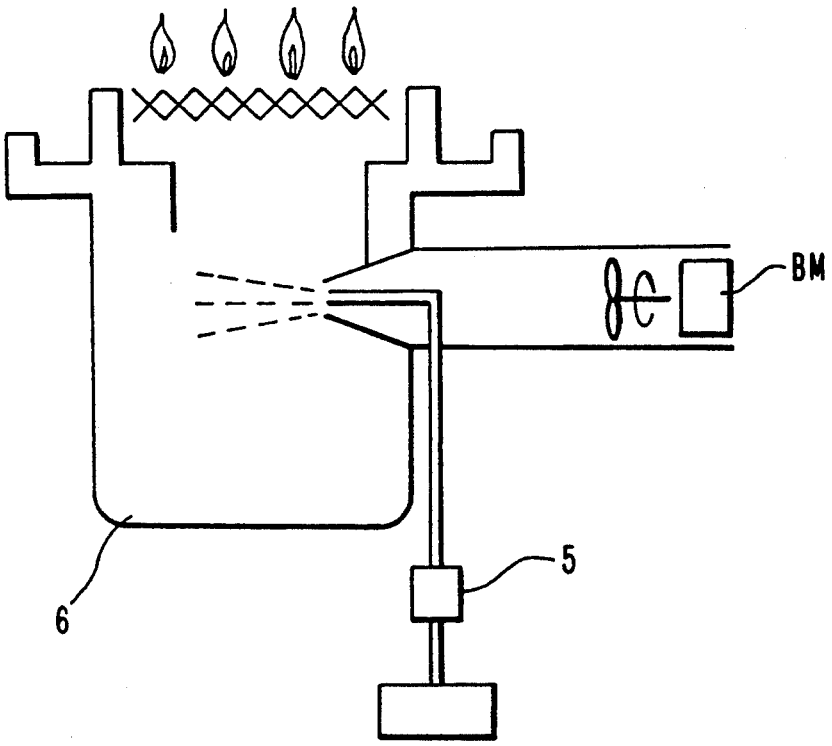
FIG. 2 PRIOR ART
FIG. 2 is a view partly showing the installment of the burner motor in the fuel burner.
Figure 3:
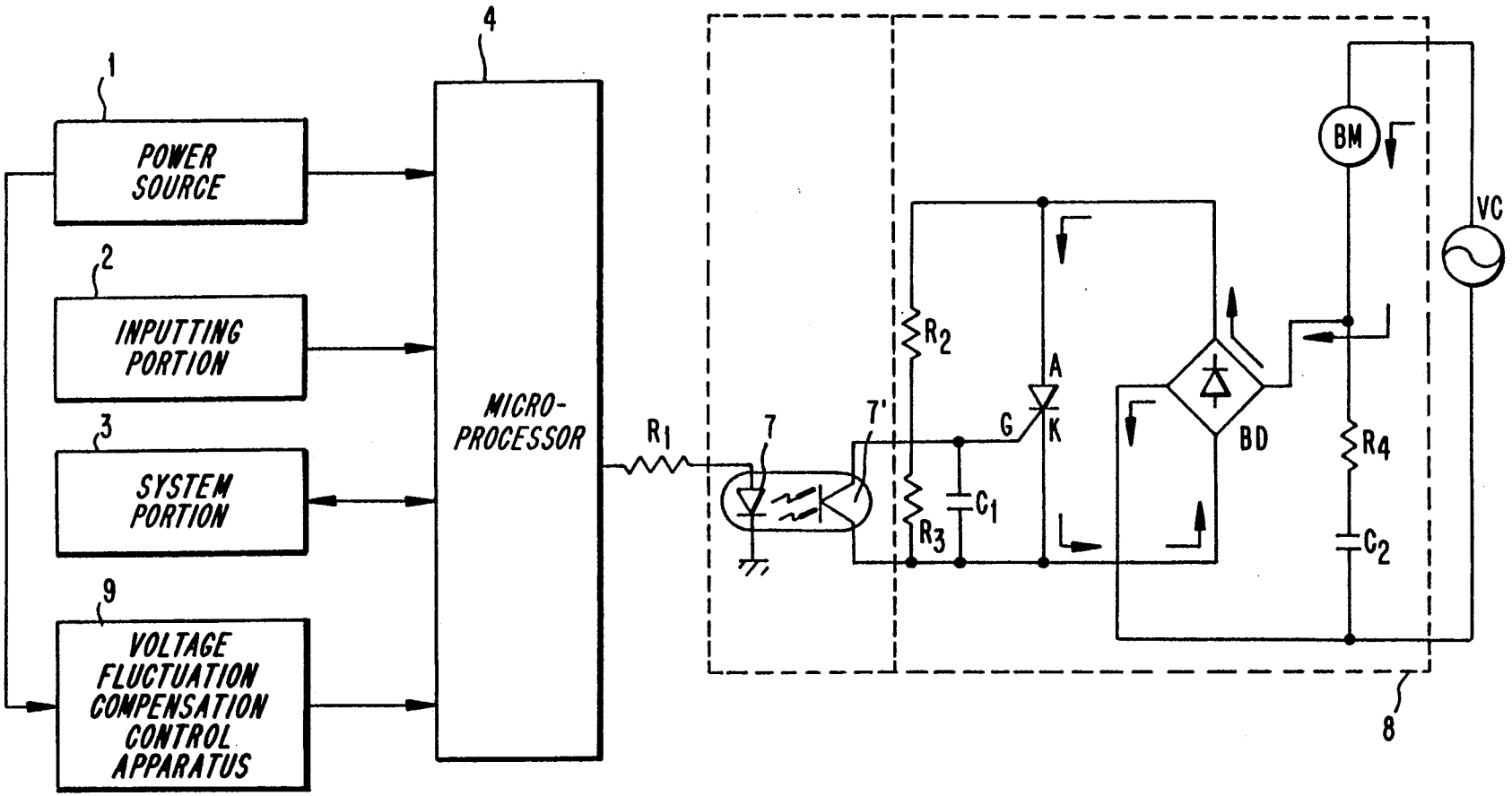
FIG. 3 is a control circuit of a burner motor showing the connection of a voltage fluctuation compensating control portion to be adapted to a fuel burner according to the invention.
Figure 4:
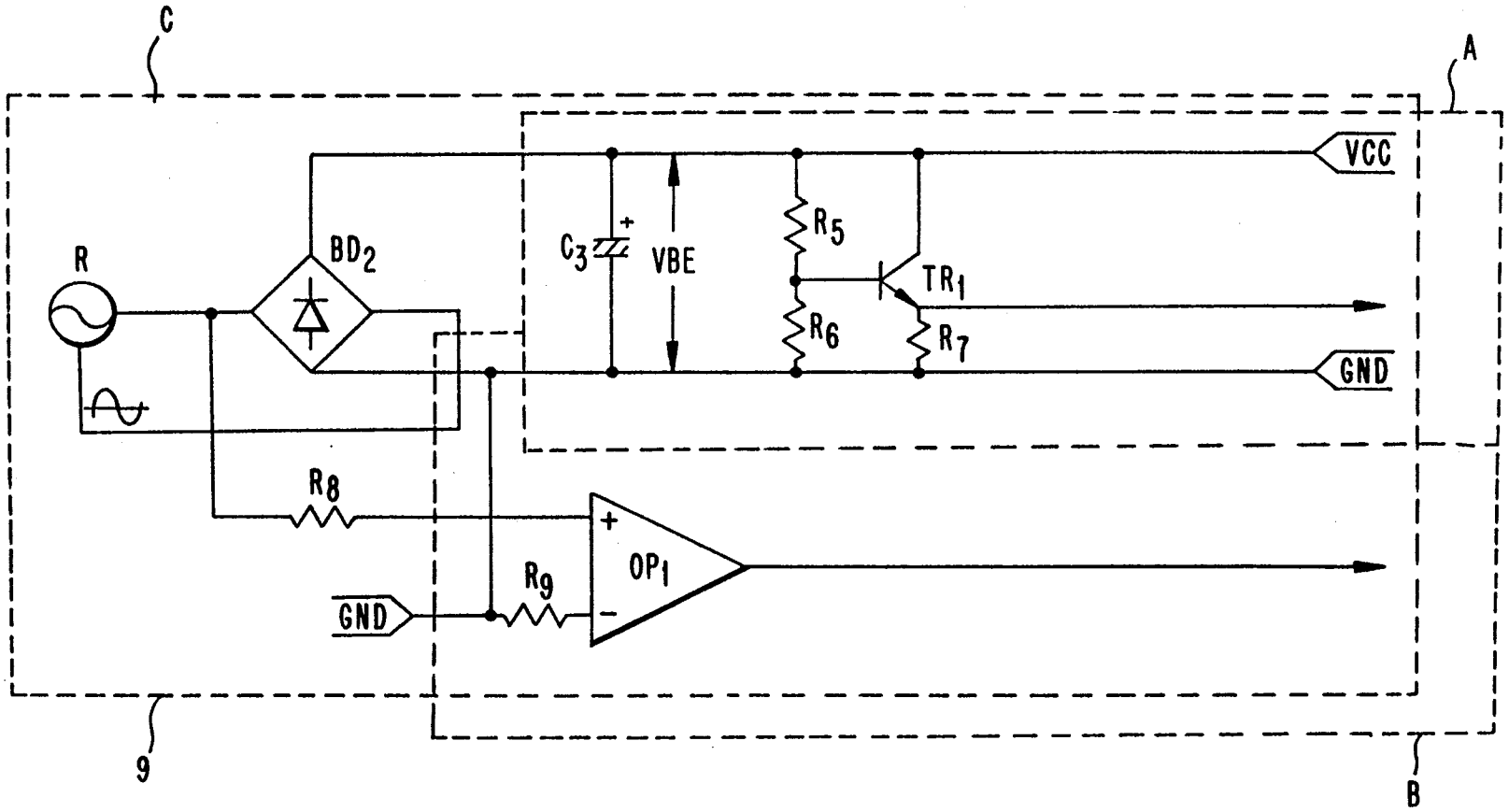
FIG. 4 is a detailed circuit of the burner motor for compensating for the voltage fluctuation according to the invention; and, FIG. 5 is a view showing the wave-forms of the comparison output from the burner motor control circuit according to the invention.
Figure 5:
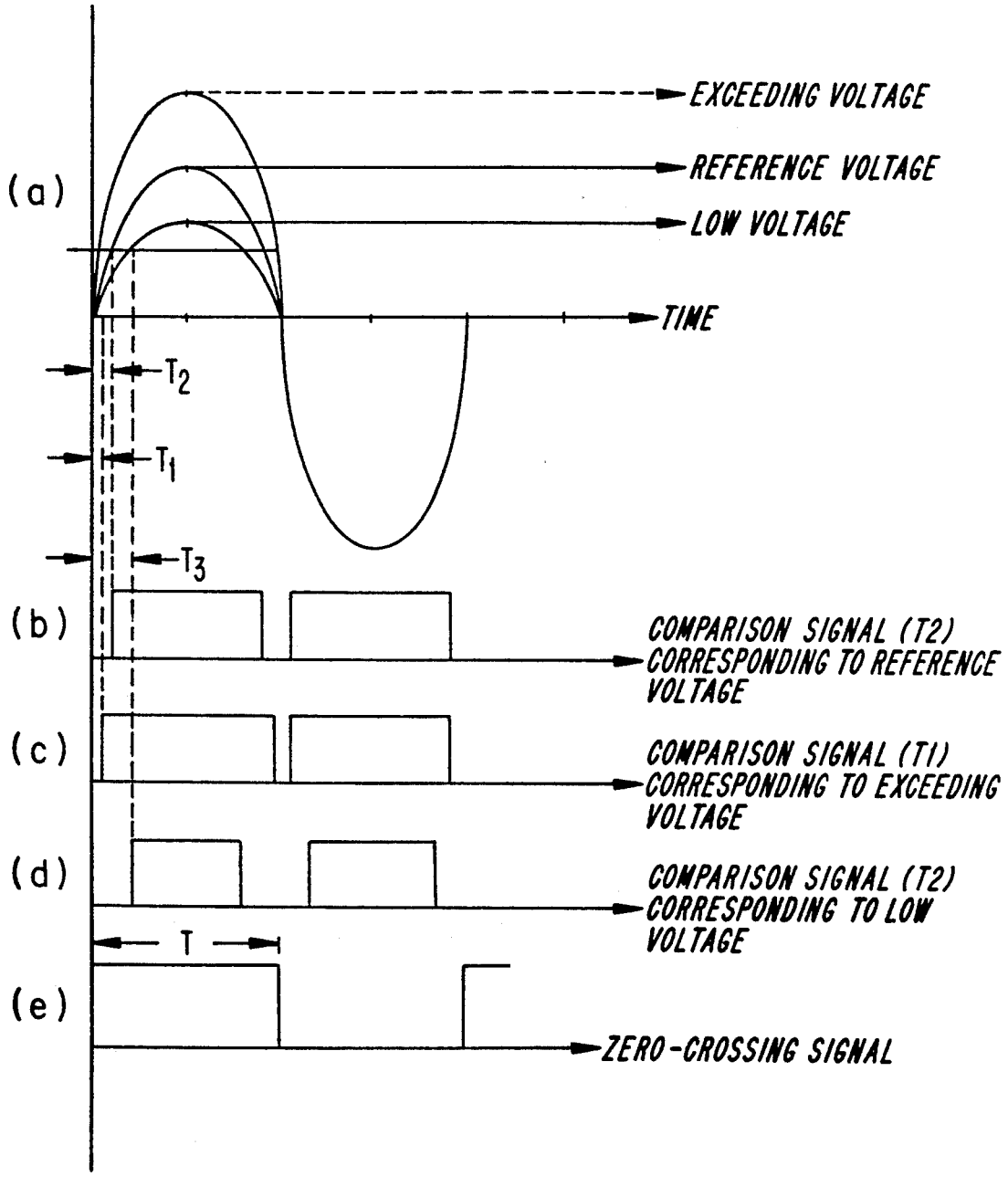

As shown in FIGS. 3 to 5, the invention is configured similarly to the conventional system. The invention is provided with a power source 1 for generating the power voltage required for a fuel burner system, an inputting portion 2 for receiving signals detected which relate to numerous key inputs including the present and the set temperatures desirable to user as well as states of a frame rod short circuit, an igniter, a blower motor rotation and a burner motor rotation, etc. Also included is a system control portion 3 for controlling the operation of loads such as the igniter, the blower motor and the burner motor based on the detected signals and a microprocessor 4 for determining a heating step dependent upon the comparison of the present temperature with the set temperature from the inputting portion 2, and for operating an electronic pump 5 coming up with the heating step and having its program predetermined for feeding a control signal to the burner motor BM to assure that air necessary for the combustion of fuel is injected into a burner 6. The burner motor BM is provided with a photocoupler including a light emitting diode 7 operated by a burner motor driving control signal from the microprocessor 4 and a transistor 7' saturated by the light received from the light emitting diode to initiate a burner motor driving portion 8.

The invention is characterized by a voltage fluctuation compensating control portion 9 as shown in FIG. 4.

The voltage fluctuation compensating control portion 9 includes a bridge circuit C for rectifying the current of a power source, a portion A for generating a comparison signal with a delay time corresponding to the voltage fluctuation of the rectified signal from the bridge circuit, and a portion B for generating a zero-crossing signal from the voltage signal of the bridge circuit C.

The bridge circuit C includes a rectifying portion $BD_2$ with four ports. A first port is connected to a power source VCC and a second port is connected to ground GND1 opposite the first port to output the full wave rectified signal. Third and fourth ports are connected in common to a current source R.

The comparison signal generating circuit A is provided with a transistor $TR_1$, the base of which is connected to the middle point of resistors $R_5$ and $R_6$, the emitter of which is grounded by means of a resistor $R_7$ and the collector of which is connected to the power source VCC. There is also a constant regulated voltage condenser $C_3$ coupled between the power source VCC and the ground GND.

The zero-crossing signal generating portion B includes a comparator $OP_1$, with a non-inverting port coupled through a resistor $R_8$ to the current source R and an inverting port grounded through a resistor $R_9$.

During the application of a power source, the invention establishes the temperature through the inputting portion 2. The microprocessor 4 receives the set temperature to control the system control portion 3. During the operation of the fuel burner, the microprocessor 4 determines the heating stage after comparing the present temperature with the set temperature, and outputs control data signals predetermined according to a program corresponding to the fuel and air supply regarding loads such as an electronic pump and a burner motor etc. Specifically the invention controls the amplitude of the power voltage applied to the burner to maintain the uniform rate of the burner motor.

The power voltage is often applied to the burner motor at a higher or lower level than the normal commercial voltage when the operation of the burner motor is controlled. If voltage fluctuation occurs, the invention compensates for the fluctuating voltage at the voltage fluctuation compensating control portion 9. Particularly, the voltage fluctuation source is rectified at a full-wave form at the bridge regulating portion $BD_2$. The full-wave rectified voltage is divided by the values of resistor $R_5$/resistors $R_5$ and $R_6$ and is applied to the base of the transistor $TR_1$ to trigger the transistor $TR_1$. At that time the fluctuation current flows from the emitter to the collector of the transistor $TR_1$.

Therefore, the normal commercial voltage of a cycle, for example 60 Hz, applied to the voltage fluctuation compensating control portion 9, as shown in the wave-form a of FIG. 5, is made into the reference voltage of a delay period $T_2$(=16.67 msec), representing the wave-form b of FIG. 5, at the comparison signal generating portion B which is connected to the rectifying portion $BD_2$. Also the voltage is applied to the comparator $OP_1$ to be changed into the voltage of a cycle T showing the wave-form e of FIG. 5. These signals are sent to the microprocessor 4.

When the transistor $TR_1$ detects the fluctuating voltage, the microprocessor 4 receives comparison signals of two types with reference to the initial point of the zero-crossing voltage period T and the saturating period $T_2$ of the transistor $TR_1$ in connection with 60 Hz of the commercial power source. One signal type is a wave-form c having a delay period $T_1$ shorter than the period $T_2$ at a relatively higher voltage input and a second type is a wave-form b having a delay period $T_3$ longer than the period $T_2$ at a relatively lower voltage input.

When the transistor $TR_1$ is turned on, the saturation voltage is assumed to be 0.7 V, and the input voltage $V_{BE}$ is indicated as follows:

$$V_{BE} = 0.7 * \sin\theta$$

$$\theta = \frac{\sin^{-1} V_{BE}}{0.7}$$

If the cycle of the commercial power source is 60 Hz, $T_2$ is equal to 16.67 msec.

Therefore, the zero-crossing period T' of the full-wave rectified voltage corresponds to 8.34 msec.

$$\text{Time constant } T = \frac{\theta}{180} * 8.34 \text{ (msec)}$$

Herein, it is noted that the saturation voltage is associated with the phase of the rectified voltage.

The microprocessor 4 determines the power voltage as the higher voltage if the comparison signal is shorter than the reference period $T_2$. Otherwise, if the comparison signal is longer than the reference period $T_2$, the power voltage is determined as the lower voltage. Then, the microprocessor 4 outputs the compensating signal previously programmed according to its program at the port having a resistor $R_1$. The compensating signal is the phase control signal, called Pulse Width control signal. The rising edge of the phase control signal is initiated at the zero-crossing point of the zero-crossing signal the period is set in a time interval to equalize an amount of the fluctuation power to the reference power.

The compensating signal disables a light emitting diode 7 during the time interval of 0 V to cut off a light receiving element 7'. A thyristor SCR is turned on to operate the burner motor BM with the power source VC being applied to the burner motor BM through a bridge rectifier $BD_1$, the thyristor SCR and the bridge rectifier $BD_1$. During the time interval of the pulse's rising portion the thyristor SCR is turned off to stop the operation of the burner motor BM.

The invention comprises the steps of generating the comparison signals and/or the zero-crossing signal corresponding to the fluctuation voltage and the reference voltage of a power source; determining whether the present input voltage is higher or lower than the reference voltage; generating the compensating signal programmed to equalize the fluctuation power to the reference power; and controlling the power to be applied to a load.

As described above, it is noted that the microprocessor 4 generates the corresponding control signal of a load programmed to compensate for the fluctuation voltage, thereby controlling the power to be supplied to the load as well as the operation of the load. Thus, the invention provides a feature that a microprocessor can stabilize the burning state of a burner by supplying enough air to be fired.

While particular embodiments of the present invention have been described and illustrated, it should be understood that the invention is not limited thereto since modifications may be made by persons skilled in the art. The present application contemplates any and all modifications that fall within the spirit and scope of the underlying invention disclosed and claimed herein.

What is claimed is:

1. A burner motor control apparatus for a fuel burner system comprising:

an input portion for receiving a plurality of key input signals and signals from peripheral equipment of the system;

a microprocessor, coupled to the input portion and having a comparison signal input and a zero-crossing signal input, for generating a control signal for controlling operation of the fuel burner system;

a system controller for controlling peripheral equipment according to the control signal from the microprocessor; and a signal generating portion for generating a zero-crossing signal that is asserted in correspondence with positive assertion of the power source voltage, and a comparison signal having a comparison time delay, defined as a time period between assertion of the zero-crossing signal and the rising edge of the comparison signal, that varies in inverse correspondence with amplitude of the rectified power source voltage, the comparison signal and the zero-crossing signal both to be input into the microprocessor, the signal generating portion including:

rectifying means for full-wave rectifying a power source voltage applied to the fuel burner system;

comparison signal generating means, coupled to an output of said rectifying means, for generating said comparison signal; and zero-crossing signal generating means, coupled to the power source voltage, for generating said zero-crossing signal, wherein the microprocessor judges whether the power source voltage is higher or lower than a normal voltage based on the comparison signal and the zero-crossing signal, and wherein the microprocessor generates a compensating signal according to the voltage fluctuation.

2. A burner motor control apparatus for a fuel burner system as claimed in claim 1, wherein the comparison signal generating means comprises:

at least one predetermined voltage dividing resistor network having an input connected to the output from said rectifying means; and a transistor having an input connected to an output of the predetermined voltage dividing resistor network, and an output producing the comparison signal corresponding to the amplitude of the power source voltage.

3. A burner motor control apparatus or a fuel burner system as claimed in claim 1, wherein:

the microprocessor determines fluctuation of the power source voltage by measuring the comparison time delay of the comparison signal and comparing it with a reference time delay of a reference signal.

4. The burner motor control apparatus for a fuel burner system as claimed in claim 3, wherein the comparison signal generating means comprises:

at least one predetermined voltage dividing resistor network having an input connected to the output from said rectifying means; and a transistor having an input connected to an output of the predetermined voltage dividing resistor network, and an output producing the comparison signal corresponding to the amplitude of the power source voltage.

5. A burner motor control method for a fuel burner system comprising the steps of:

generating a comparison signal corresponding to the amplitude of a power source voltage, and generating a zero-crossing signal corresponding to the period of the power source voltage;

determining whether the amplitude of the power source voltage is higher or lower than an amplitude of a reference voltage based on the comparison signal and the zero-crossing signal; and outputting a signal for controlling the phase angle of the power source voltage applied to a burner motor according to the result of the step of determining, wherein the step of generating the comparison signal comprises the steps of:

applying the power source voltage to a voltage dividing resistor network; and applying the output of the voltage dividing resistor network to an input of a transistor, wherein an output of the transistor is the comparison signal, and wherein the generated comparison signal has a comparison time delay, defined as a time period between assertion of the zero-crossing signal and the rising edge of the comparison signal, that varies in inverse correspondence with amplitude of the power source voltage, and wherein the step of determining further includes the step of measuring the comparison time delay of the comparison signal and comparing it with a reference time delay of a reference signal.

* * * * *